US008430388B2

(12) United States Patent
Masters

(10) Patent No.: US 8,430,388 B2
(45) Date of Patent: Apr. 30, 2013

(54) MODEL AIRPLANE WORK STATION

(76) Inventor: Jack A. Masters, Dry Ridge, KY (US)

( * ) Notice: Subject to any disclaimer, the term of this patent is extended or adjusted under 35 U.S.C. 154(b) by 0 days.

(21) Appl. No.: 12/807,811

(22) Filed: Sep. 14, 2010

(65) Prior Publication Data

US 2011/0079947 A1 Apr. 7, 2011

Related U.S. Application Data

(60) Provisional application No. 61/276,478, filed on Sep. 14, 2009.

(51) Int. Cl.

| | |
|---|---|
| ***B23Q 1/25*** | (2006.01) |
| ***B23Q 17/00*** | (2006.01) |
| ***B25B 1/22*** | (2006.01) |
| ***B25B 1/02*** | (2006.01) |
| ***B25B 5/02*** | (2006.01) |
| ***B25B 1/00*** | (2006.01) |
| ***B25B 1/24*** | (2006.01) |
| ***B25B 5/16*** | (2006.01) |
| *B25H 1/04* | (2006.01) |

(52) U.S. Cl.
USPC ..... 269/296; 269/76; 269/211; 269/152; 29/407.05

(58) Field of Classification Search ..... 269/296, 269/76, 211, 152, 45; 29/407, 407.05
See application file for complete search history.

(56) References Cited

U.S. PATENT DOCUMENTS

| | | | | |
|---|---|---|---|---|
| 2,827,690 | A * | 3/1958 | Brown | 269/17 |
| 4,153,243 | A * | 5/1979 | Batchelor | 472/9 |
| 4,558,583 | A * | 12/1985 | Shaw et al. | 72/389.6 |
| 4,591,114 | A * | 5/1986 | Block | 244/120 |
| 4,700,559 | A * | 10/1987 | Larson et al. | 72/461 |
| 4,900,000 | A * | 2/1990 | Solberg | 269/152 |
| 4,949,944 | A * | 8/1990 | Groff, Sr. | 269/45 |
| 5,188,247 | A * | 2/1993 | Jastrow | 212/343 |
| 5,335,900 | A * | 8/1994 | Bonde | 269/51 |
| 5,338,015 | A * | 8/1994 | Liegel et al. | 269/71 |
| 6,671,941 | B2 * | 1/2004 | Scott et al. | 29/407.05 |
| 7,238,078 | B2 * | 7/2007 | Kimura | 446/232 |
| 7,448,606 | B1 * | 11/2008 | Johnson | 269/17 |
| 8,069,019 | B2 * | 11/2011 | Cazals | 703/2 |

FOREIGN PATENT DOCUMENTS

JP 09000746 A * 1/1997

* cited by examiner

*Primary Examiner* — Lee D Wilson
*Assistant Examiner* — Alvin Grant
(74) *Attorney, Agent, or Firm* — Carrithers Law Office, PLLC

(57) ABSTRACT

A work station for securely and temporarily holding a model airplane for the purpose of making adjustments, repairs or performing other maintenance on the plane. The work station is on wheels, contains a tool box with tools and a clamp and cradle to securely hold the airplane or only the fuselage, if desired. The work station can be disassembled and stored away in the back of a small vehicle. The clamp and cradle may be mounted on the tool box, which may be easily removed from the work station. In this way, the tool box acts as smaller portable work station, as well.

20 Claims, 5 Drawing Sheets

MODEL AIRPLANE WORK STATION

CROSS REFERENCE TO RELATED APPLICATIONS

This application also claims priority from Provisional Application Ser. No. 61/276,478 filed on Sep. 14, 2009 which is incorporated by reference in its entirety herein.

TECHNICAL FIELD

The present invention relates to the field of work stations for holding a model airplane and a toolbox so that a user has two free hands to work on the airplane and tools within easy reach.

DESCRIPTION OF THE RELATED ART

Tool boxes are well known in the art and vary in size, shape, capacity, type of storage (i.e. drawers, shelving, trays, etc.), portable or fixed, and so on. Work stations for various purposes are also well known, e.g., automotive, welding, medical, etc.

BACKGROUND OF THE INVENTION

As stated above, tool boxes and work stations are well known in the art. However, a work station that holds a tool box and a model airplane in a convenient, comfortable and easily accessible position is not known to the inventor. Such a work station is needed. The work station should also have an adjustable cradle and clamp that would easily and securely hold the fuselage of a model airplane in an upright, up-side-down, or perhaps sideways position while the user works on it, the user having both hands free. This cradle and clamp would preferably be mounted on the handle of the tool box so that the tool box could be removed from the work station. The tool box, along with the cradle and clamp holding a model airplane, thus provides another smaller work station which can be carried easily to any desired location, such as a table, the ground or any flat surface, and used there.

SUMMARY OF THE INVENTION

The present invention provides a work station provided with a toolbox, a cradle and a clamp which can easily and securely hold a model airplane in a convenient position, allowing hands free adjustments and maintenance on the model airplane. The plane can be secured in whatever position is needed, that is, upright, on its side or upside-down. The cradle can be adjusted to accommodate different sizes of model airplanes. Further, the work station may be easily disassembled or broken down for transport or storage while simultaneously holding the airplane securely. The cradle may be mounted on the work station or on the toolbox which is removably attached to the work station.

The model airplane work station comprises, consists essentially of and/or consists of two vertical support members integrally connected to a wall member, said vertical members extending below said wall member and each member connected to an outrigger and a wheel, said vertical members extending upward and containing vertically disposed slots, and receivers mounted below said slots for retaining handles removably clamped therein, a tool box which has a bottom, two sides and two ends, said ends being taller than said sides, and a cylindrical handle connected at the top of said two ends and extending beyond said ends and terminating on each end with an end cap, an adjustable fuselage clamp slidably disposed on one end of said cylindrical handle and an adjustable fuselage cradle at an opposing end of said cylindrical handle.

It is an object of this invention to provide a portable work station which contains a toolbox and an adjustable cradle which can securely hold a model airplane or just the fuselage of an airplane so that a user can work on it.

It is an object of this invention to provide a portable work station which holds the model airplane and a toolbox at a comfortable height for a user standing on a surface beside the work station.

It is an object of this invention to provide a portable work station which can easily break down and fit in a trunk, hatchback or the like.

It is an object of this invention to provide a portable work station wherein the toolbox is detachable from the work station and the adjustable cradle which holds the model airplane is integral with the tool box such that the tool box provides a stable base. In this way, the user can secure the model airplane in the cradle while the toolbox and cradle are detached from the work station and place the tool box on a table or the ground, for example. The model airplane is safe because it is secured within the cradle and the tool box provides a generous footing and ballast to keep the cradle upright.

It is an object of the present invention to provide an alternated portable work station which has a cradle mounted on the work station rather than on the tool box.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
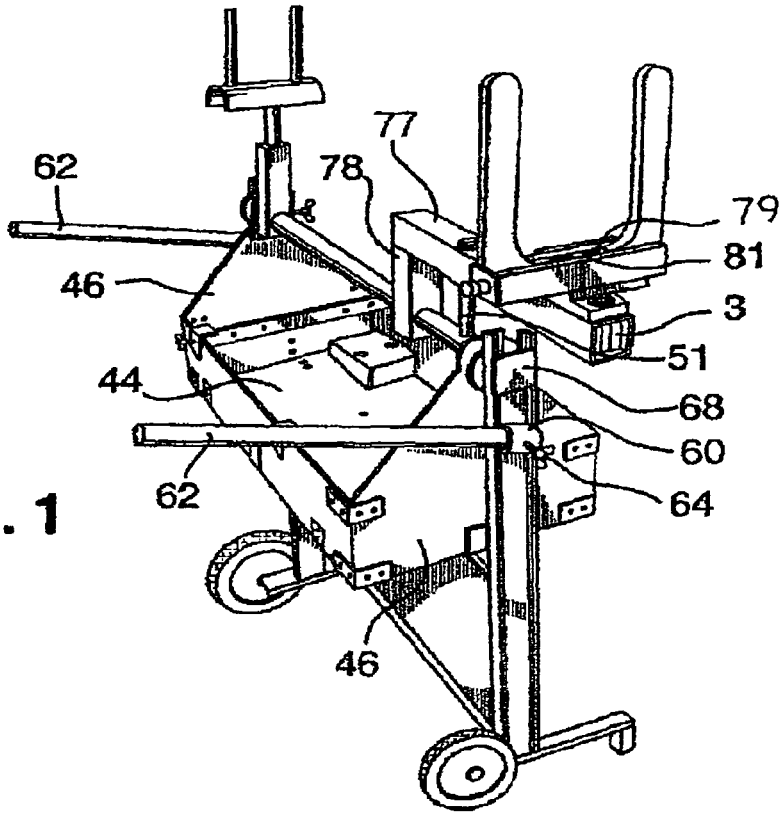
FIG. 1 is an oblique view of the model airplane tool work station.

In accordance with the present invention, there is provided a model airplane work station 10 supported by a frame 41. As shown in the figures, two vertical support members 30 and 31 define a pair of legs which are fastened to a medial support panel 33. Outriggers define a pair of feet 38 extending horizontally from the distal ends of the legs 30, 31. A pair of wheels 36 are mounted to the feet at the point they join to the legs 30, 31. A short portion of the distal ends 37 of the feet 38 are bent downward perpendicular thereto for supporting the feet opposite the wheels at a selected height to maintain the frame in a level condition.

The top end of legs 30 and 31 extend upward whereby the distal ends include a slot or fork 50 to receive and pivotally hold the rod 45 of the tool tray 52 and thereby support tool tray 52 and model plane support assembly. Work station handles 62 are held in receivers 60 by wing screw 64. These handles 62 extend at a 20 degree angle and are removable. Work station handles 62 provide a means for pushing or pulling the work station and are removable for storage. They also by be used as legs to support the work station when it is in the tilted down position.

Toolbox 52 has a bottom 44 connected by sides 42 and ends 46 which project upward higher than sides 42 and include apertures in the upper top portions. The cylindrical handle or rod 45 is disposed through the apertures of the toolbox ends 46 and pivotally connected at the top center of ends 46 whereby the rod 45 is includes end caps 68. At least one preferred embodiment, includes adjustable divider walls 48 extending laterally across from sidewall to sidewall and are slidably clamp mounted on sides 42 and also provide structural support. The clamps slide down over the top edge of the sides of the tool tray and can be fastened tight at desired location of rails placement, using thumb screws to tighten the clamps to the trays side walls. Toolbox 52 can rest on a flat surface or may be rotatably suspended from slots 50 on work station 10.

Figure 9:
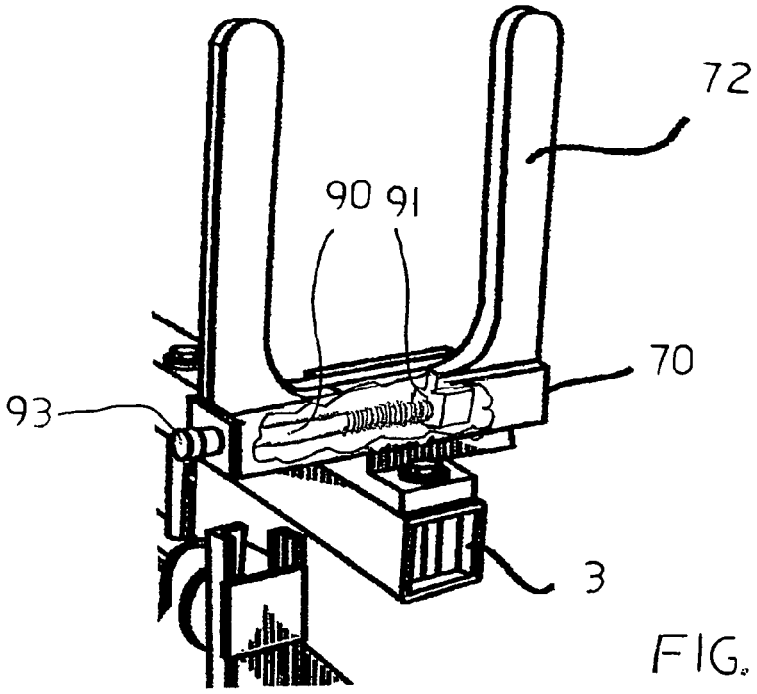
FIG. 9 is a internal view of the clamp fork adjustment knob screw 90 threaded into coaxial member 91.
Figure 10:
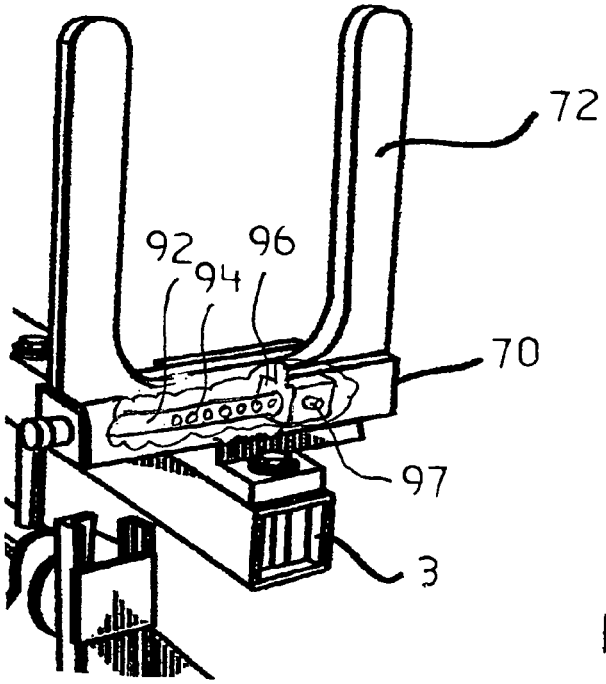
FIG. 10 is an internal view of the clamp fork slidably adjustable coaxial members with holes and a pin.

The adjustable fuselage L-clamp 70 comprises a fork made from two vertical longitudinal holding members 72, 73 having a horizontal inner distal end portion 79 and outer distal end portion 81 which fit slidably one into the other for a sliding motion adjustment for adjusting the size of the clamp opening to accommodate the size of an airplane's fuselage. The distal end portions 79, 81 may be tubular members or channel members. As shown in FIG. 9, a knob cap screw 93 is inserted into a threaded bore of an outer coaxial member 91 or, as shown in FIG. 10, a pin 97 extends through a plurality of holes 94 formed in the coaxial longitudinal members to slidably adjust same. With reference to FIG. 9, the threaded rod 90 of knob cap screw 93 is threaded into the coaxial member 91 which is integral with the longitudinal holding member 72 providing means for opening and closing of the clamp jaws. An alternative embodiment, shown in FIG. 10 provides adjustment of the clamp jaws by removing pin 97, sliding longitudinal holding member 72 to a desired position, and re-inserting pin 97 in coaxial longitudinal members 92 and 97.

The support frame for holding the model plane for repair or maintenance includes a short "L-shaped member 25 is attached to side of the outer distal end portion 81. The base 26 of the member 25 includes a hole therethrough for slidable horizontal adjustment along the length of adjustable L-brace clamp base or gooseneck 3 which comprises a horizontal member 77 supported by a short vertical member 78 which holds the plane in suspended position for easy cleaning and maintenance of the plane. The adjustable horizontal member 77 includes a longitudinal slot 27 on its top surface whereby a bolt, wingnut or other holding member 26 is disposed through the hole in member 25 which is slidably supported on the horizontal member 77 for holding the member 25 and L-clamp 70 at a selected position along the slot 27 depending upon the length of the fuselage of the plane.

The plane gooseneck 3 slides forward or backward on a longitudinal member defining a pipe or rod 45 extending from each end of the work station to provide for adjustment based on the length of the fuselage of the model plane. The rod 45 also serves as a tray handle.

In one preferred embodiment, a vertical support member defines a straight brace 51 extends from the rod 45 to a selected point of the bottom of the gooseneck horizontal member 77. A spring loaded member such as a pin or bolt extends from the top of the member 77 downward through the slot 27 for cooperative engagement with the straight brace 51. Lifting on the pin pulls the spring backwards allowing form sliding movement of the gooseneck 3 vertical member 48 along the rod 45 and movement of the straight brace 51 along the slot 27.

Figure 2:
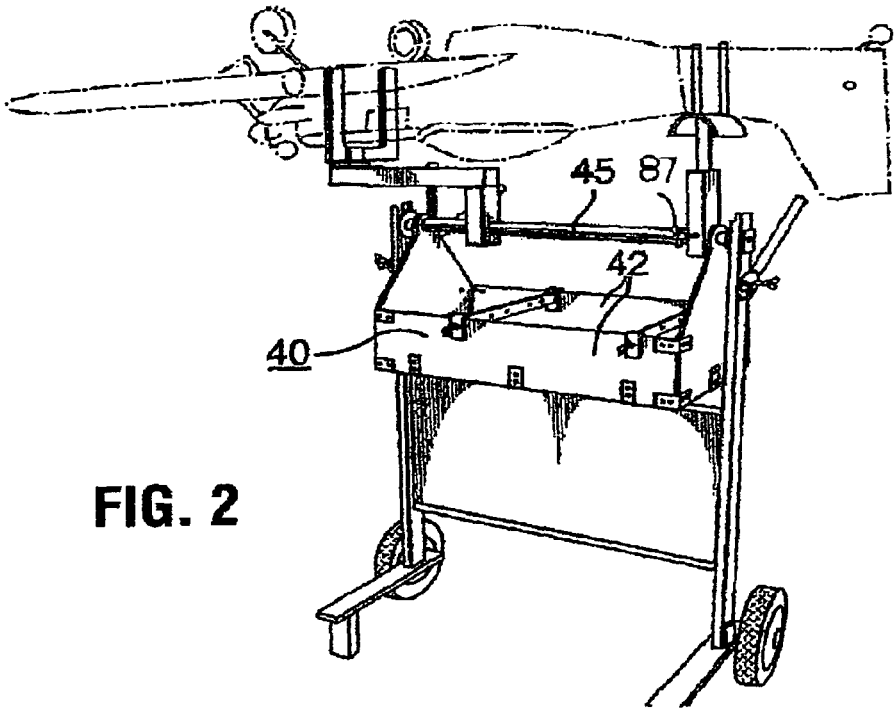
FIG. 2 is an oblique view of the model airplane work station with a model airplane secured in the cradle.
Figure 3:
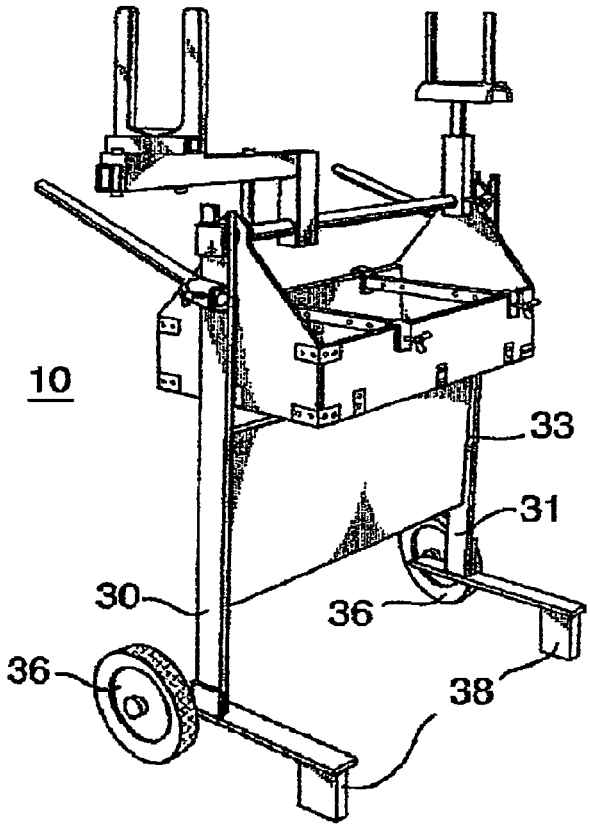
FIG. 3 is another oblique view of the model airplane work station with a model airplane secured in the cradle.
Figure 4:
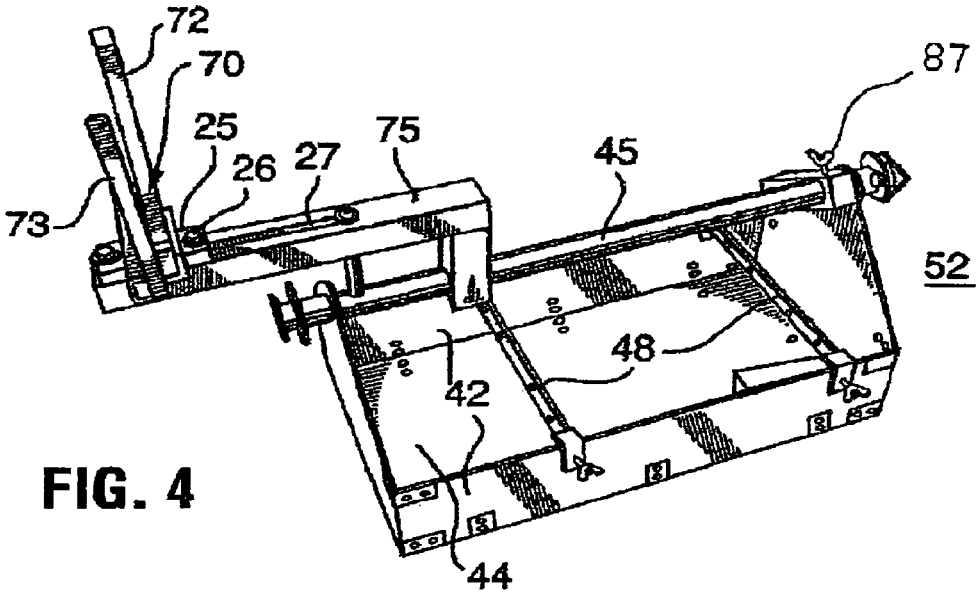
FIG. 4 is an oblique view of the tool box with part of the cradle mounted on it's handle.
Figure 5:
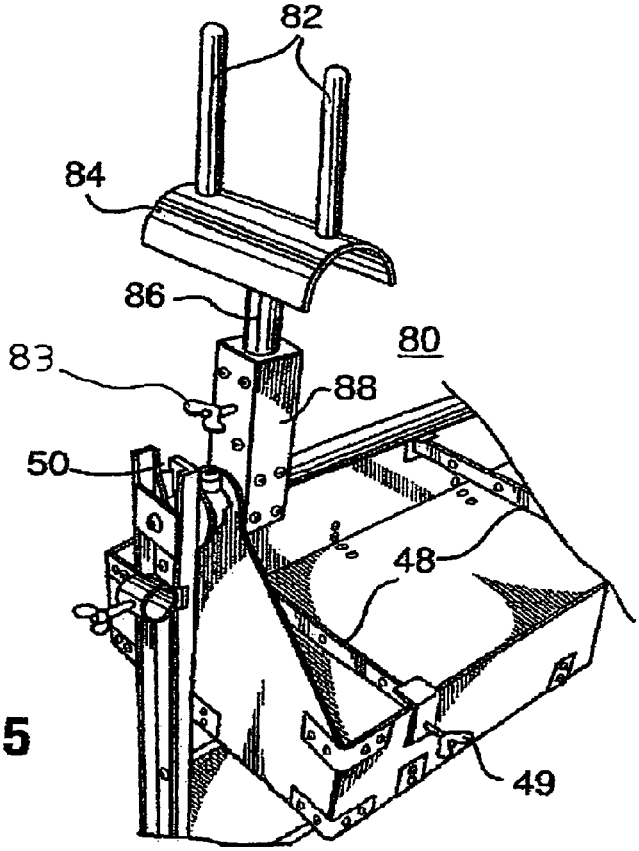
FIG. 5 is an oblique view of the left side of the tool box mounted on the work station.
Figure 6:
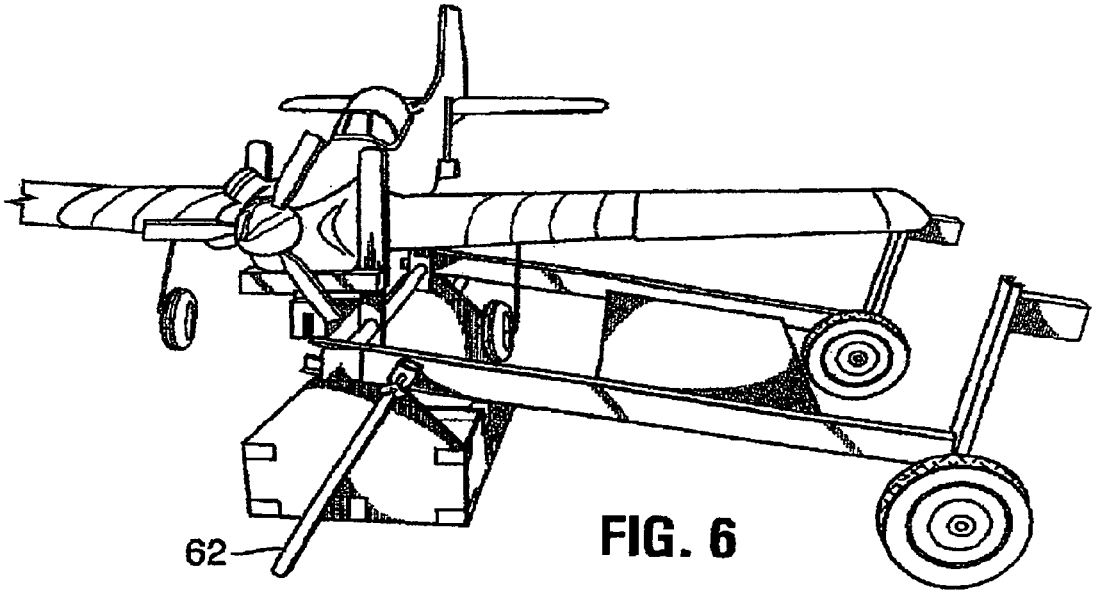
FIG. 6 is an oblique view of the model airplane work station with a model airplane secured in the cradle showing the top of work station lowered to the ground and resting on it's wheels and handles.
Figure 7:
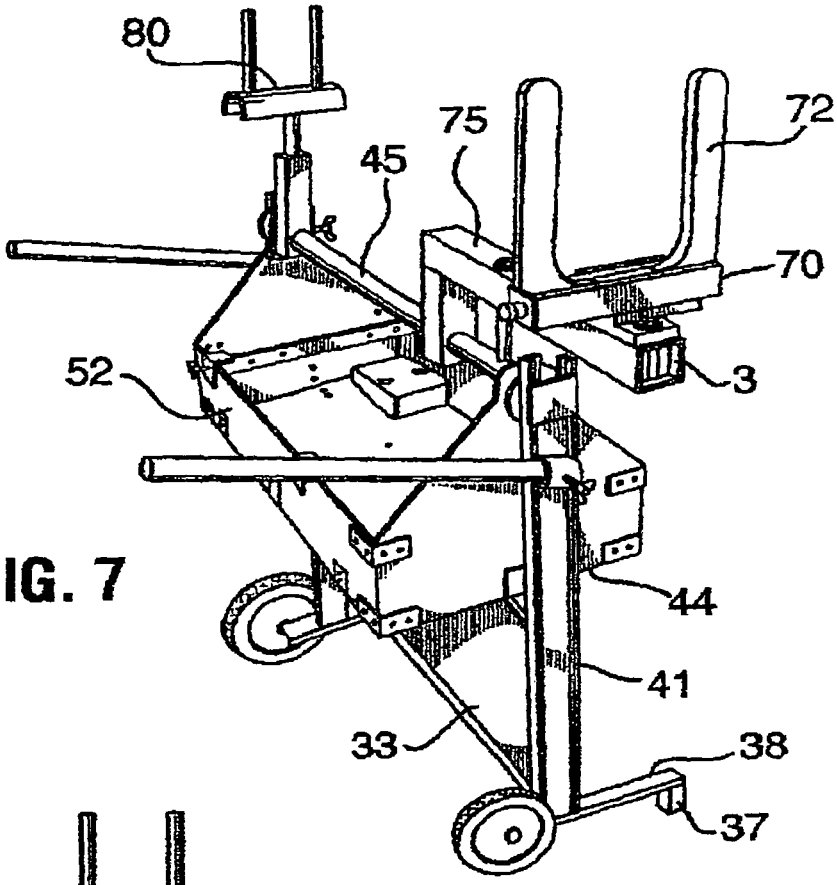
FIG. 7 is a right oriented oblique view of the model airplane work station.
Figure 8:
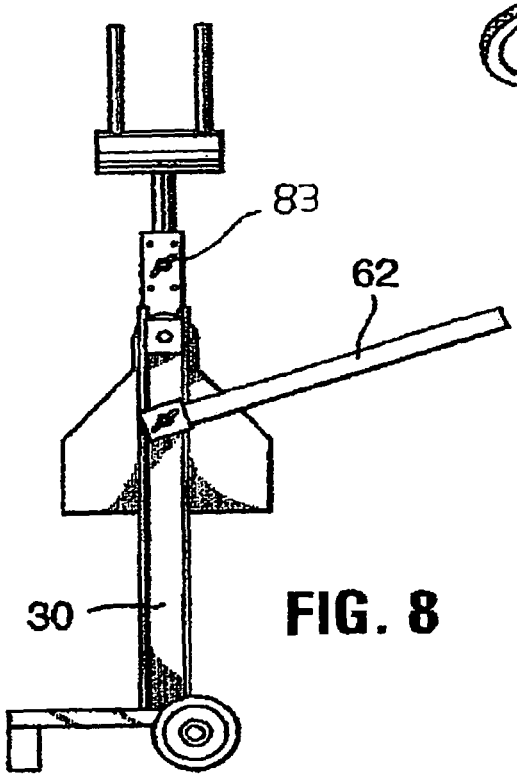
FIG. 8 is an end view of the model airplane work station.

As best shown in FIG. 3, fuselage cradle 80 provides a place for the tail of the fuselage to rest. The fuselage cradle 80 includes a block 88 which is slidably supported by rod 45. A vertical support rod or radius stand 86 extends into a bore extending into block 88 and is held into place at a selected height by a thumb screw 83, set screw or other means for holding to allow vertical adjustment of the tail wing support brace 80 to compensate for differential shapes, and sharper angles of bottom of air plane fuselages, and tail wings. As shown in FIGS. 2 and 4, thumb screw 87 can be loosened to slidably and rotatably adjust block 88 along the length of rod 45. An inverted semicircular length of pipe defines a base 84 attached to and supported by the radius stand 86 oriented perpendicular to the rod 45 for supporting the tail end of the fuselage of the model plane. A pair of spaced apart vertical rods 82 projecting vertically on each end of the base 84 to prevent the fuselage from sliding of the base 84 and for holding the plane back while throttling. The base 84 and rods 82 are typically covered with a rubber foam such as pipe insulation to protect the plane body surface. It is anticipated that all points where the clamp and cradle would contact the airplane may be covered with a means for cushioning the surface such as soft padding material, rubber or some elastomeric material or the like.

All of the points of assembly are fastened with wing screws but it is anticipated that snap pins, rivets, adhesives, spring loaded ball and socket snap fits, over center devices or other connecting means may be used or combinations thereof.

An alternative embodiment has the plane clamp and cradle mounted on the work station directly. The removable tool box may also be directly mounted to the work station as well.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A model airplane work station comprising:

two vertical support members integrally connected to a wall member, said two vertical support members extending below said wall member and each said vertical support member connected to an outrigger and a wheel; said vertical members extending upward and containing vertically disposed slots at a top end, and receivers mounted below said slots for retaining handles removably clamped therein;

a tool box comprising a bottom, two sides and two ends, said ends being taller than said sides; and a cylindrical handle connected at the top of said two ends and extending beyond said ends and terminating on each end with an end cap;

an adjustable fuselage clamp slidably disposed on one end of said cylindrical handle; and an adjustable fuselage cradle at an opposing end of said cylindrical handle.

2. The model airplane work station defined in claim 1 wherein said adjustable fuselage cradle is both rotatably adjustable and horizontally adjustable.

3. The model airplane work station defined in claim 1 wherein said adjustable fuselage cradle includes a vertical adjustment of a fuselage supporting surface.

4. The model airplane work station defined in claim 1 wherein said retaining handles are capable of supporting the weight of said tool box and said cart when said cart is tipped down so that free ends of said retaining handles rest on a floor.

5. The model airplane work station defined in claim 1 wherein said tool box contains adjustable divider walls.

6. The model airplane work station defined in claim 1 wherein surfaces of said clamp and said cradle which contact said fuselage is covered with means for cushioning said surfaces.

7. A model airplane work station comprising:

two vertical support members integrally connected to a wall member, said two vertical support members extending below said wall member and each said vertical support member connected to an outrigger and a wheel; said vertical members extending upward and containing vertically disposed slots at a top end, and receivers mounted below said slots for retaining handles removably clamped therein;

a tool box comprising a bottom, two sides and two ends, said ends being taller than said sides; and a cylindrical handle connected at the top of said two ends and extending beyond said ends and terminating on each end with an end cap;

an adjustable fuselage clamp slidably disposed on one end of said cylindrical handle; and an adjustable fuselage cradle at an opposing end of said cylindrical handle; and said tool box containing adjustable divider walls.

8. The model airplane work station defined in claim 7 wherein said adjustable fuselage cradle is both rotatably adjustable and horizontally adjustable.

9. The model airplane work station defined in claim 7 wherein said adjustable fuselage cradle includes a vertical adjustment of a fuselage supporting surface.

10. The model airplane work station defined in claim 7 wherein said retaining handles are capable of supporting the weight of said tool box and said cart when said cart is tipped down so that free ends of said retaining handles rest on a floor.

11. A model airplane work station comprising:

two vertical support members integrally connected to a wall member, said two vertical support members extending below said wall member and each said vertical support member connected to an outrigger and a wheel; said vertical members extending upward and containing vertically disposed slots at a top end, and receivers mounted below said slots for retaining handles removably clamped therein;

a tool box comprising a bottom, two sides and two ends, said ends being taller than said sides; and a cylindrical handle connected at the top of said two ends and extending beyond said ends and terminating on each end with an end cap;

an adjustable fuselage clamp slidably disposed on one end of said cylindrical handle; and an adjustable fuselage cradle at an opposing end of said cylindrical handle; and said surfaces of said clamp and said cradle which contact said fuselage covered with means for cushioning said surfaces.

12. The model airplane work station defined in claim 11 wherein said adjustable fuselage cradle is both rotatably adjustable and horizontally adjustable.

13. The model airplane work station defined in claim 11 wherein said adjustable fuselage cradle includes a vertical adjustment of a fuselage supporting surface.

14. The model airplane work station defined in claim 11 wherein said retaining handles are capable of supporting the weight of said tool box and said cart when said cart is tipped down so that free ends of said retaining handles rest on a floor.

15. A model airplane work station comprising:

two vertical support members connecting to a base, said vertical members extending upward and containing means for holding at a top end and means for holding handles removably held therein;

a tool box comprising a bottom, two sides and two ends, said ends being taller than said sides and said ends including pivotal means for attaching a longitudinal member thereto connecting a top portion of said two ends and extending beyond said ends and terminating on each end attaching to a top end of said vertical support members;

an adjustable fuselage clamp slidably and pivotally mounting on one end of said longitudinal member; and an adjustable fuselage cradle slidably and pivotally mounting to an opposing end of said cylindrical handle.

16. The model airplane work station defined in claim 15 wherein said tool box contains adjustable divider walls.

17. The model airplane work station defined in claim 15 wherein surfaces of said clamp and said cradle which contact said fuselage is covered with means for cushioning said surfaces.

18. The model airplane work station defined in claim 15 wherein said adjustable fuselage cradle is both rotatably adjustable and horizontally adjustable.

19. The model airplane work station defined in claim 15 wherein said adjustable fuselage cradle includes a vertical adjustment of a fuselage supporting surface.

20. The model airplane work station defined in claim 15 wherein said retaining handles are capable of supporting the weight of said tool box and said cart when said cart is tipped down so that free ends of said retaining handles rest on a floor.

* * * * *